US008025479B2

(12) United States Patent
Scott

(10) Patent No.: US 8,025,479 B2
(45) Date of Patent: Sep. 27, 2011

(54) IMPELLER

(75) Inventor: Thomas M. Scott, Lucas, OH (US)

(73) Assignee: The Gorman-Rupp Company, Mansfield, OH (US)

( * ) Notice: Subject to any disclaimer, the term of this patent is extended or adjusted under 35 U.S.C. 154(b) by 273 days.

(21) Appl. No.: 12/294,707

(22) PCT Filed: Mar. 28, 2007

(86) PCT No.: PCT/US2007/007802

§ 371 (c)(1), (2), (4) Date: Sep. 26, 2008

(87) PCT Pub. No.: WO2007/126981

PCT Pub. Date: Nov. 8, 2007

(65) Prior Publication Data

US 2010/0239417 A1 Sep. 23, 2010

(51) Int. Cl.
*F04D 29/24* (2006.01)

(52) U.S. Cl. ..... 415/206; 416/185; 416/223 B; 416/DIG. 2

(58) Field of Classification Search ..... 415/71–75, 415/204, 206; 416/176, 177, 179, 185, 186 R, 416/223 B, DIG. 2

See application file for complete search history.

(56) References Cited

U.S. PATENT DOCUMENTS

| | | | | |
|---|---|---|---|---|
| 948,228 | A * | 2/1910 | Krough | 416/186 R |
| 948,288 | A | 2/1910 | Bausmith | |
| 1,864,834 | A | 6/1932 | Klosson | |
| 2,272,469 | A | 2/1942 | Lannert | |
| 2,420,420 | A | 5/1947 | Durdin, Jr. | |
| 4,681,508 | A | 7/1987 | Kim | |

* cited by examiner

*Primary Examiner* — Christopher Verdier

(74) *Attorney, Agent, or Firm* — Tarolli, Sundheim, Covell & Tummino LLP

(57) ABSTRACT

A pump impeller for a centrifugal pump. The impeller is defined by a shroud rotatable about an axis of rotation. At least two pump vanes extend axially from the shroud, each of the vanes configured as a blunted tear drop shape and having an inside wall and an outside wall, the leading edges of which are interconnected by a blunt wall. The trailing edges of the inside and outside walls merge together. A substantially constant width flow channel is defined between the blunted wall of one vane and a confronting surface defined by an inside wall of the other vane. The vanes are tapered in the axial directions by inclining the inside wall of each vane radially outwardly.

23 Claims, 7 Drawing Sheets

IMPELLER

TECHNICAL FIELD

The present invention relates generally to centrifugal pumps and in particular to a new and improved centrifugal pump impeller.

BACKGROUND ART

Centrifugal pumps often use multiple vane impellers to pump fluid such as water from an inlet to an outlet. Pump impellers are currently available which have two or more vanes. In order to pass solids through the pump, it is often desirable to utilize a two or three vane impeller. It has been found that existing two and three vane impellers may operate at reduced efficiencies and/or can be unacceptably noisy especially when run at higher speeds in order to generate higher head pressures.

In the most recognized standard two vane impeller design for solids handling the two vanes are normally relatively perpendicular to the shroud. Each vane usually has a constant width of, for example 0.38 inch. In order to pass the required solids the distance between an inlet leading edge of one vane and a trailing edge at the O.D. of the other vane (the space between the two vanes) may be too far apart for "normal/good" hydraulic design. Due to this spacing, the flow transition from an inside surface of the vane to an outside or working side of the vane in the suction region is unstable, especially at flows to the right or left of the "best efficiency point" (BEP). As the flow enters the working side of the vane it dumps into a "void" (open area) that causes the flow to recirculate back to the underside side of the vane. It is believed that these factors reduce the hydraulic efficiency and cause cavitation/noise.

DISCLOSURE OF THE INVENTION

The present invention provides a new and improved fluid pump which has increased hydraulic efficiency. In particular, the present invention provides a new and improved impeller for a fluid pump such as a centrifugal pump.

According to the invention, the pump impeller is rotatable within a pump chamber defined by the fluid pump and is driven by a source of rotation such as a motor. The impeller includes a shroud that is rotatable about an axis of rotation and at least two pump vanes that extend substantially axially from the shroud. Each vane is defined by an inside wall and an outside wall, the leading edges of which being interconnected by a substantially blunted wall. The vanes are arranged such that a flow channel is defined at least partially between the blunted wall of one vane and a portion of the inside wall of the other vane.

According to a feature of this invention, the flow channel has a substantially constant width, and more preferably, a constant cross-section.

In the preferred and illustrated embodiment, each vane is shaped as a truncated tear drop wherein the outside and inside walls of each vane merge together at a trailing end of each vane. In order to achieve this feature, the radius of the outside wall is greater than the radius of the inside wall.

In the exemplary embodiment, each vane tapers in the axial direction such that a width of a vane at a vane base where a given vane joins the shroud has a greater width than a distal side of the vane which is located near the inlet of the pump when the impeller is located within the pump chamber. In a more preferred embodiment, the tapering is achieved by inclining the inside surfaces of the inside wall of each vane outwardly such that the spacing between the vanes at the distal surface is greater than the spacing of the vanes at the vane base. With this configuration, each flow channel defined between the vanes defines a larger opening near the inlet of the pump and thus facilitates the pumping of entrained solids by the impeller.

According to the illustrated embodiment, the width of each flow channel does not vary by substantially more than 10%.

In the illustrated embodiment, the shroud is attached to a drive shaft forming part of the pump by suitable structure such as a threaded bore which is adapted to receive the threaded end of the drive shaft. According to another feature of the invention, a plurality of pump out vanes or channels are defined on the shroud and urge fluid between the underside of the shroud and a pump housing outwardly during rotation of the impeller.

The "truncated tear drop vane" configuration of the present invention actually extends a working side of the vane into the "void" region described above. As the flow transitions to this "extended" working side of the vane the flow is pushed or directed outward to the "actual" working side of the vane. This increases the hydraulic efficiency and reduces recirculation. The wider vane thickness also helps seal off leakage between the top face of the vane and the wear plate. This improves the efficiency at BEP a little but the largest advantage of this style vane is that it reduces the H.P. required at flows to the right or the left of BEP. It also appreciatively reduces the noise at flows to the right or left of BEP. This allows a pump fitted with the disclosed impeller to be operated at faster speeds and over an increased operating range and still have acceptable noise levels. The faster speeds produce desired higher head pressures while using the same size pump.

Additional features of the invention and a fuller understanding will be obtained by reading the following detailed description made in connection with the accompanying drawings.

BEST MODE FOR CARRYING OUT THE INVENTION

Figure 1:
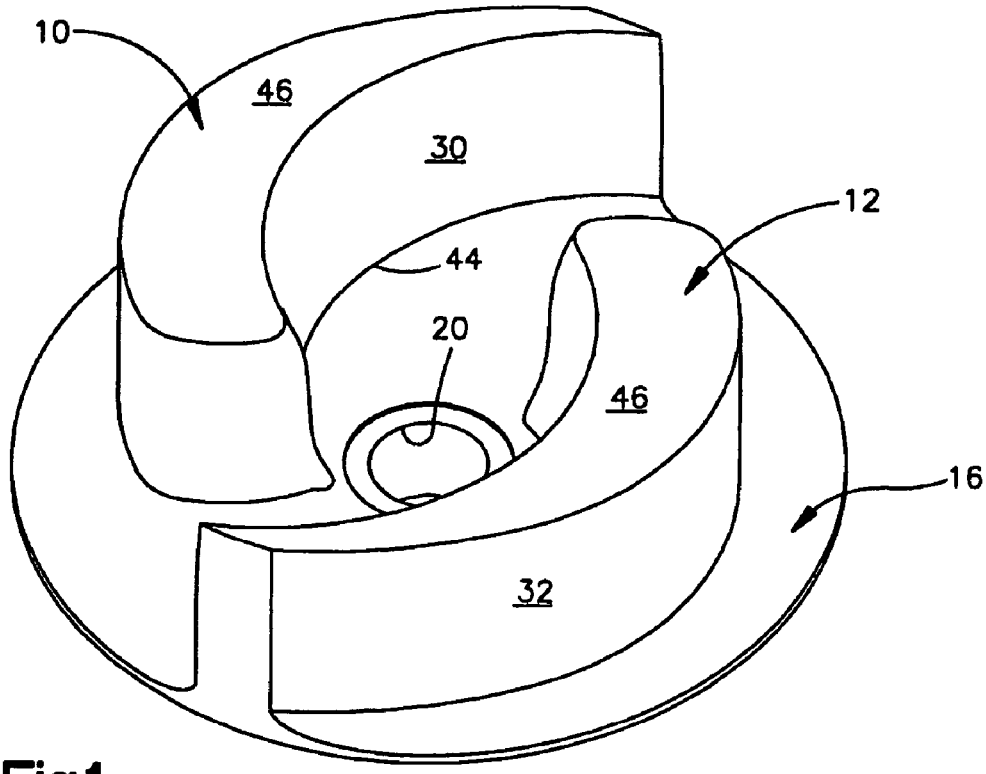
FIG. 1 is a perspective view of a pump impeller constructed in accordance with a preferred embodiment of the invention.

FIG. 1 illustrates the overall construction of an impeller embodying the present invention. The illustrated impeller includes two vanes 10, 12 which as viewed in FIG. 1, extend upwardly from a shroud 16. The shroud 16 defines a centrally positioned, threaded bore 20 by which the impeller is secured to a drive shaft (not shown). The drive shaft typically has a threaded end which is threadedly received by the bore 20. Other methods for attaching the impeller to the shaft such as keyways are also contemplated. The impeller typically rotates within an impeller chamber (not shown) which may be formed at least partially by a volute (not shown). Generally, the central portion of the impeller as viewed in FIG. 2 communicates with an inlet through which fluid i.e. water is drawn into the impeller chamber. The rotation of the impeller, in the counterclockwise direction, as viewed in FIG. 2 causes the water to be discharged, under pressure, to an outlet (not shown) which communicates with a peripheral portion of the impeller.

An example of a centrifugal pump that may utilize an impeller constructed in accordance with the present invention is disclosed in U.S. Pat. No. 6,887,034 which is hereby incorporated by reference. Another example of a pump that may use the impeller shown in FIG. 1 is disclosed in U.S. Pat. No. 3,898,014 which is also hereby incorporated by reference.

In the preferred and illustrated embodiment, the vanes 10, 12 and shroud 16 are integrally formed such as by casting. The raw casting is then generally machined to more precisely define the impeller shown in FIG. 1.

Figure 3:
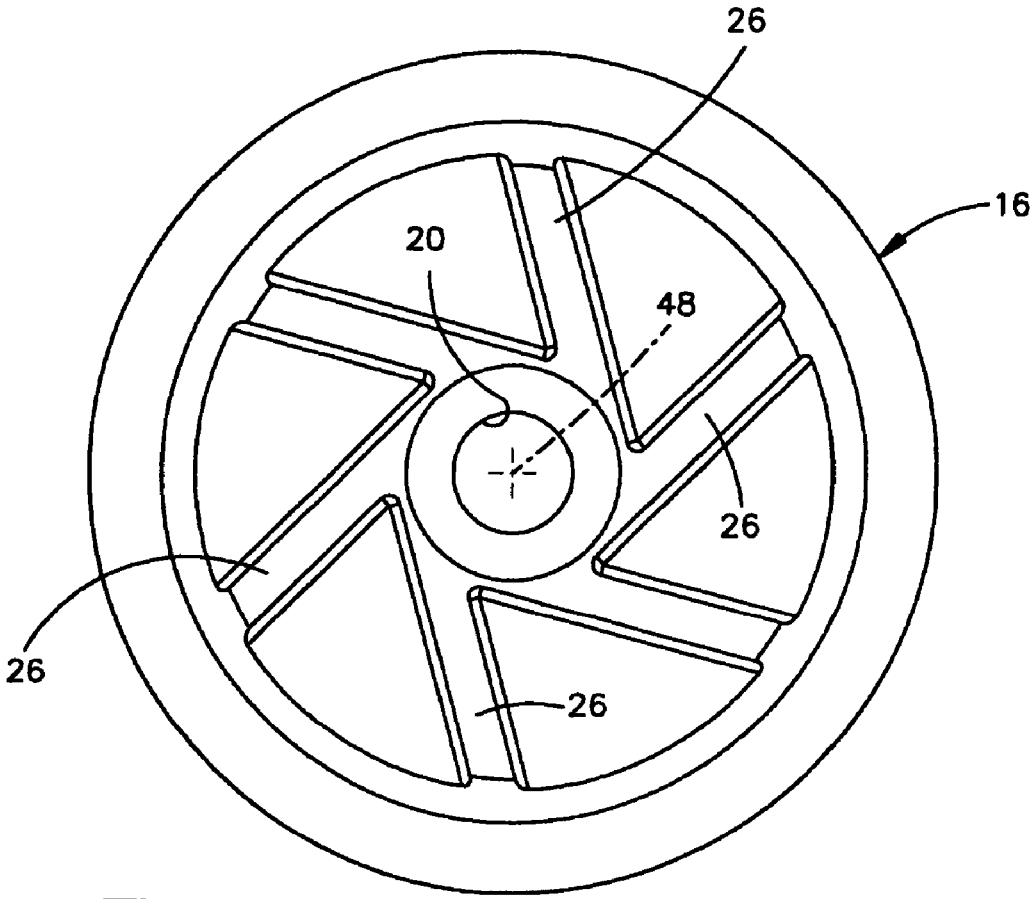
FIG. 3, is a plan view of an underside of the impeller shown in FIG. 1.
Figure 4:
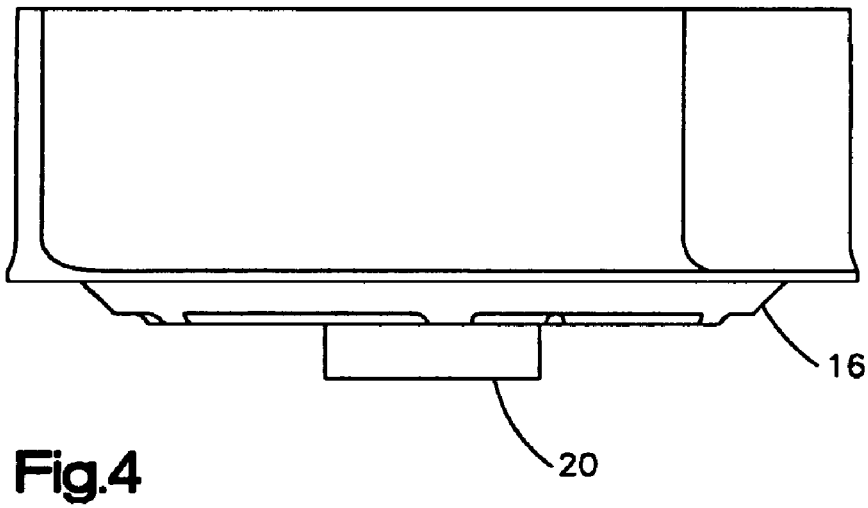
FIG. 4 is a side elevational view of the impeller as seen from the plane indicated by the line 4-4 in FIG. 2.

FIG. 3 illustrates the underside of the shroud 16 and as can be seen in this illustration, a plurality of pump out vanes 26 are defined or cast into the shroud. When the impeller is rotating, these channels drive the fluid and entrained solids between the underside of the impeller and the pump housing outwardly, i.e. towards the outer diameter of the impeller.

Referring again to FIG. 2, the vanes are shaped as truncated or blunted tear drops. In particular, each vane is defined by two curved, sidewalls 30, 32 having different radii so that the vane narrows at a trailing edge indicated generally by the reference character 36. As seen best in FIG. 2, the leading edge of each vane is defined by a blunt wall 38 that joins and interconnects the sidewalls 30, 32. The blunted wall is shaped and positioned so that a flow channel, indicated generally by the reference character 40 is defined between the blunt wall 38 of one vane and at least a portion of the inner sidewall 30 of the other vane. As seen best in FIGS. 1, 2 and 12-15, the sidewalls 30, 32 have their greatest separation at the blunted wall 28. In other words, each vane is widest at the blunted wall 38. Consequently, two such flow channels 40 each having a substantially constant cross section are defined. It has been found, that the illustrated impeller produces less noise in operation especially at higher speeds. The efficiency of the pump is also substantially improved over a wider operating range.

Figure 5:
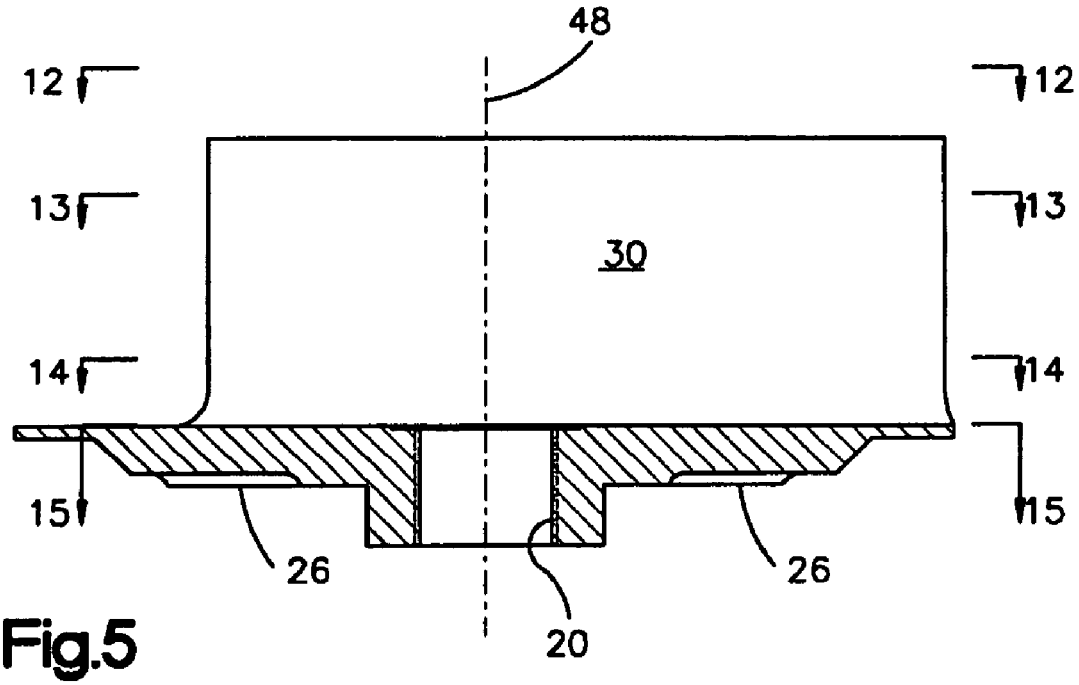
FIG. 5 is a sectional view of the impeller as seen from the line 5-5 in FIG. 2.
Figure 6:
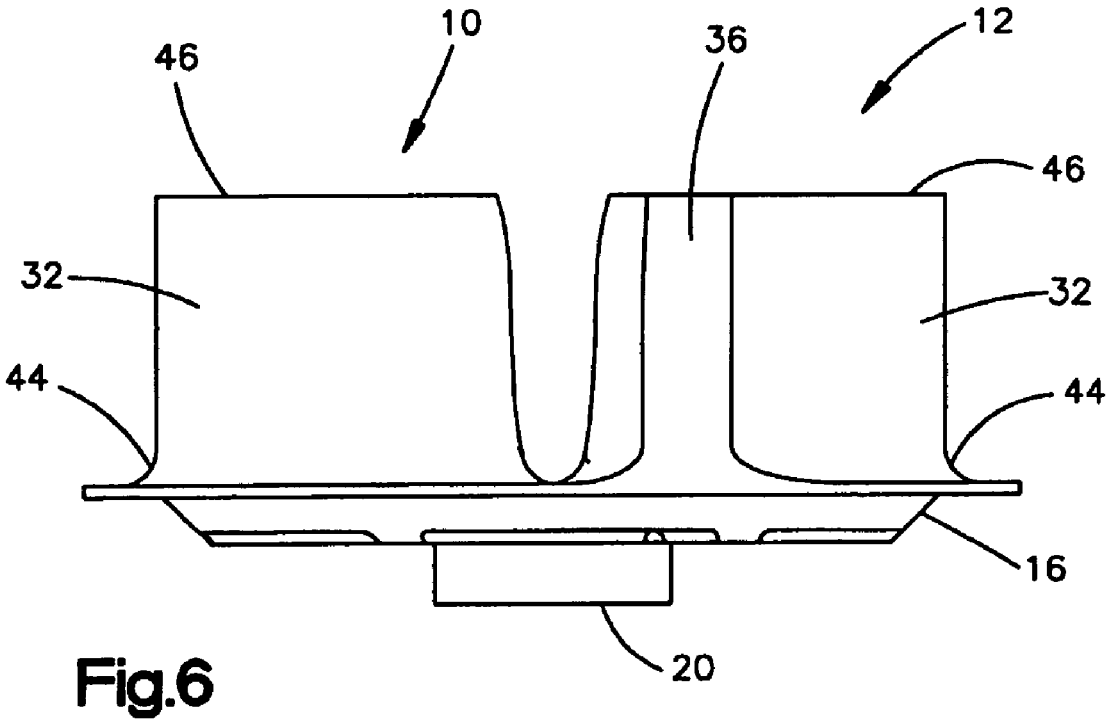
FIG. 6 is another side elevational view of the impeller as seen from the line 6-6 in FIG. 2.
Figure 7:
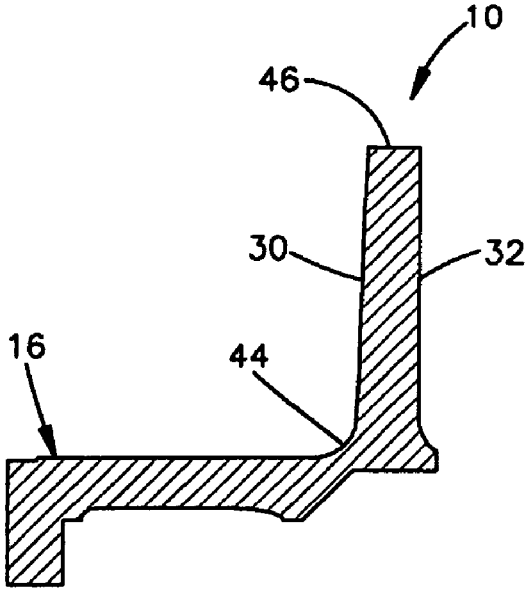
FIG. 7 is a fragmentary sectional view of the impeller as seen from the plane indicated by the line 7-7 in FIG. 2.
Figure 8:
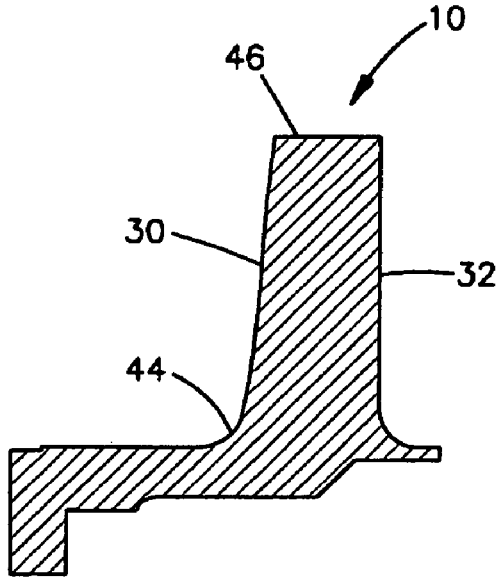
FIG. 8 is another fragmentary sectional view of the impeller as seen from the plane indicated by the line 8-8 in FIG. 2.
Figure 9:
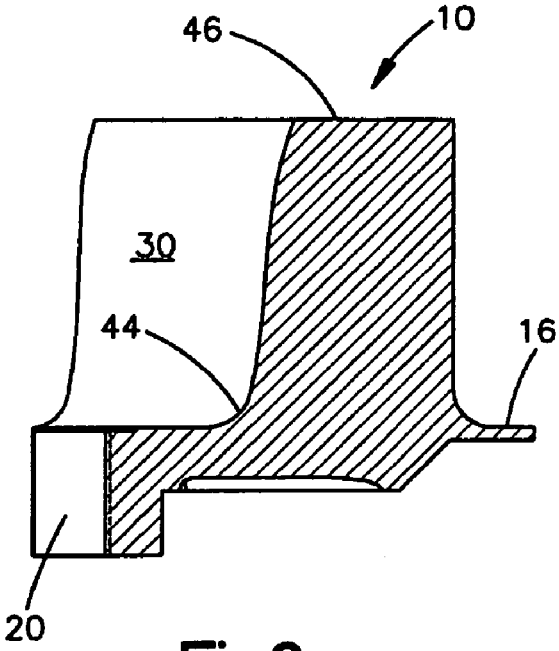
FIG. 9 is another fragmentary sectional view of the impeller as seen from the plane indicated by the line 9-9 in FIG. 2.
Figure 10:
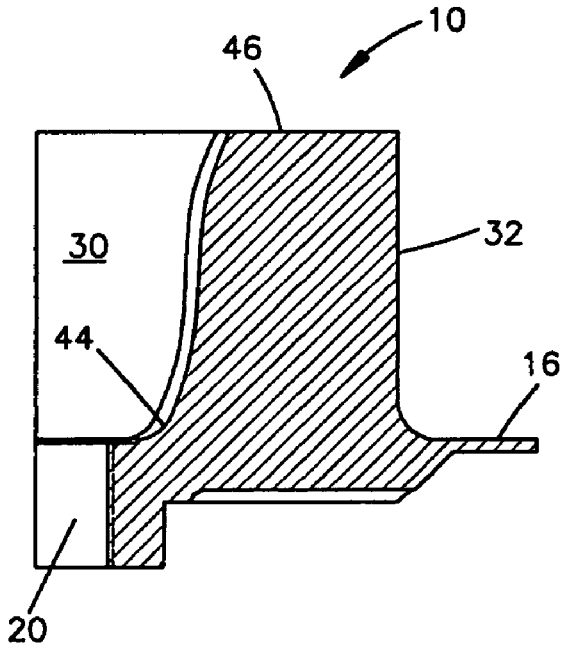
FIG. 10 is a fragmentary sectional view of the impeller as seen from the plane indicated by the line 10-10 in FIG. 2.

Referring to FIGS. 1, 2 and 7-10, it can be seen that each vane preferably tapers from a vane base 44 to a top or distal end surface 46 of the vane. This surface is located near the pump inlet when the impeller is in the pump chamber. This is achieved by inclining the inner sidewalls of each vane. The resulting cross section of each vane at various locations are seen best in FIGS. 7-10. As seen in these Figures, the inclination of the inner walls 30 of the vanes 10, 12 can vary along their extent. In the preferred embodiment, the outer sidewalls 32 of each vane are substantially constant and are substantially parallel to an axis of rotation of the impeller indicated by the reference character 48 in FIG. 3 and FIG. 5.

Figure 2:
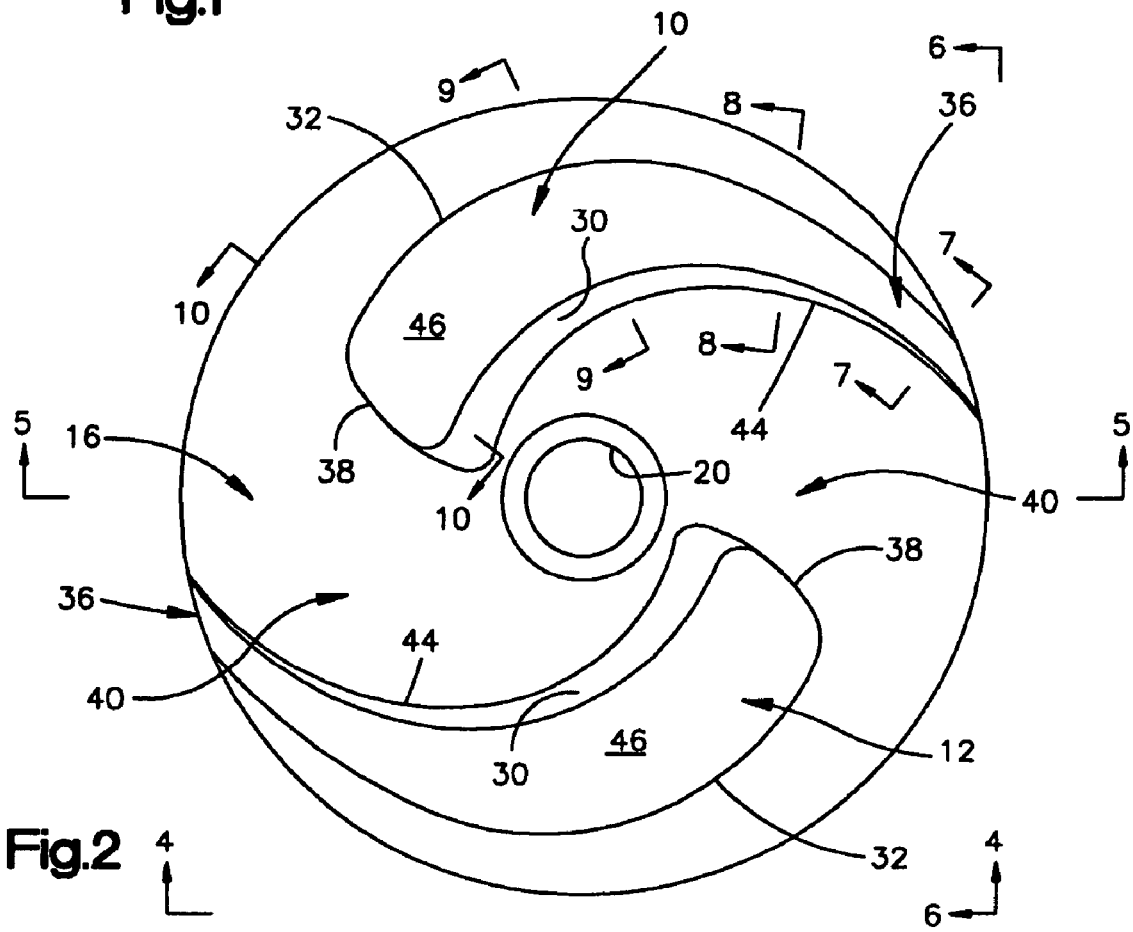
FIG. 2, is a plan view of the impeller shown in FIG. 1.

As seen best in FIGS. 1 and 2, the outward inclination of the inner sidewalls 30 of each vane causes the spacing between the vanes to be larger at the tops 46 of the vanes (as viewed in FIG. 2) than at their bases 44. It has been found that a larger spacing at the tops of the vanes which is nearer the pump inlet (not shown), improves the solids handling capability of the pump. FIGS. 12-15 illustrate the variation in cross section of each as one proceeds from the base 44 of a vane and the top surface 46 of the vane.

Figure 11:
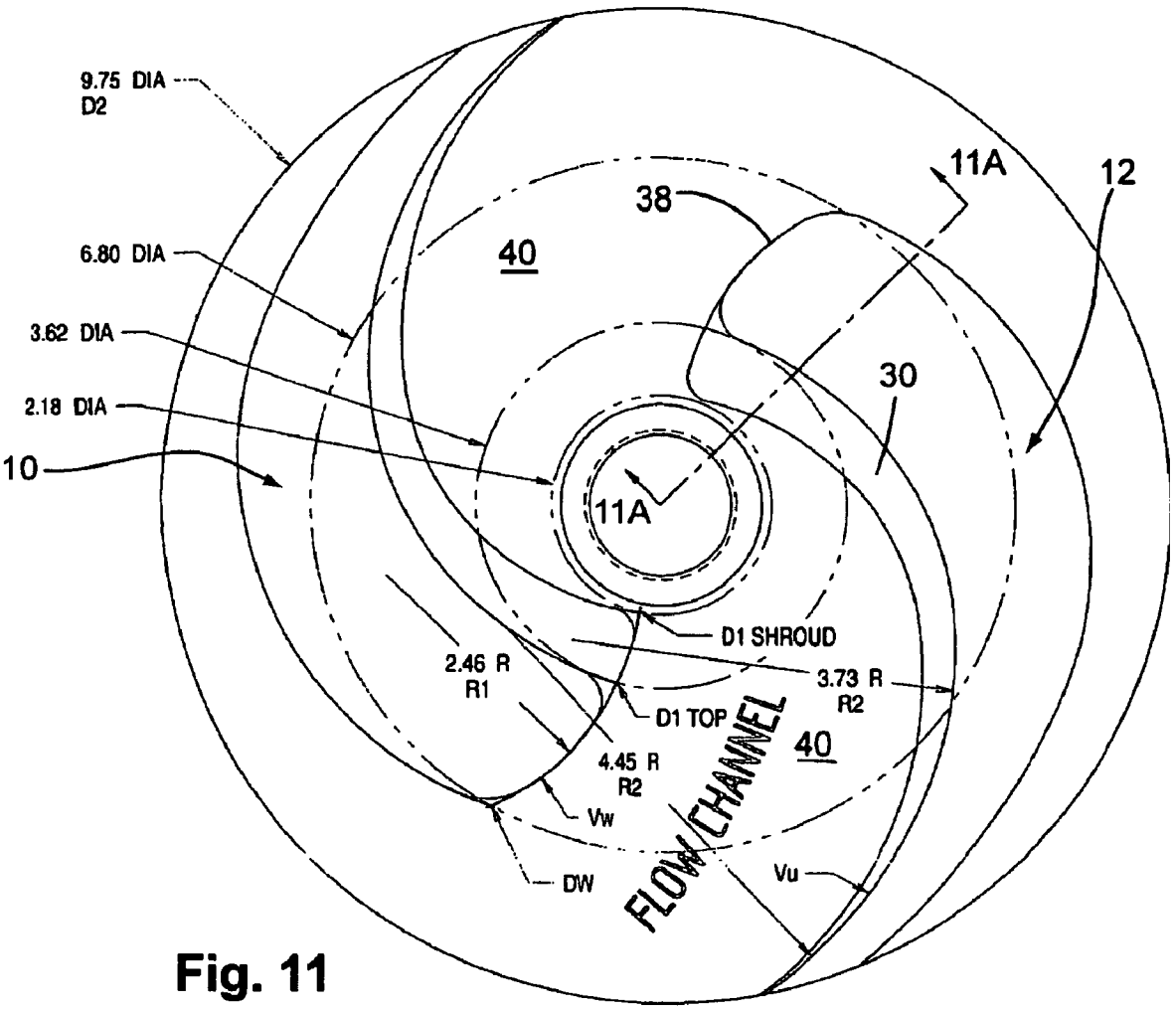
FIG. 11 is a plan view of the impeller showing the relationship between the vanes in the flow channel along with dimensions for an impeller constructed in accordance with a preferred embodiment of the invention.
Figure 11A:
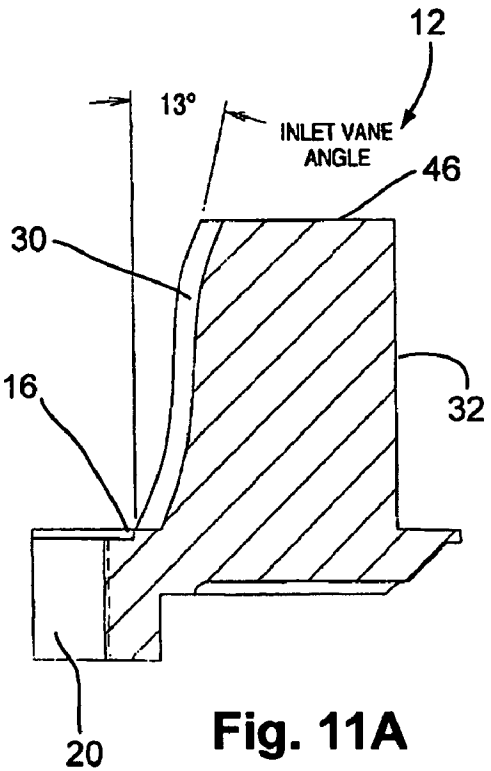
FIG. 11A is a fragmentary sectional view as seen from the plane indicated by the line A-A in FIG. 11.
Figure 12:
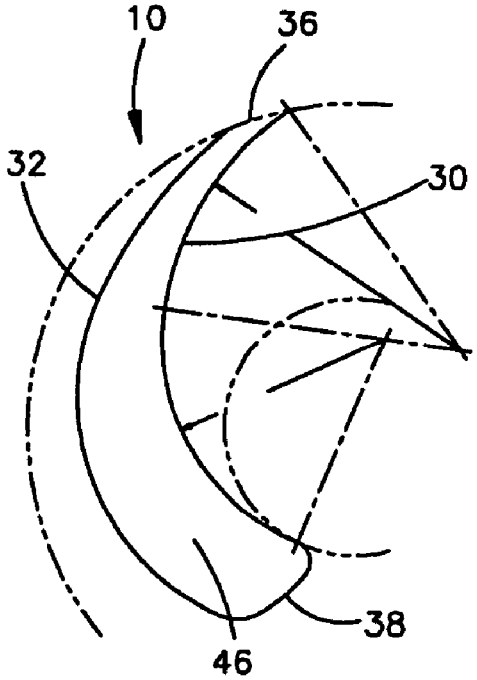
FIG. 12 is a top plan view of a vane as seen from the plane indicated by the line 12-12 in FIG. 5.
Figure 13:
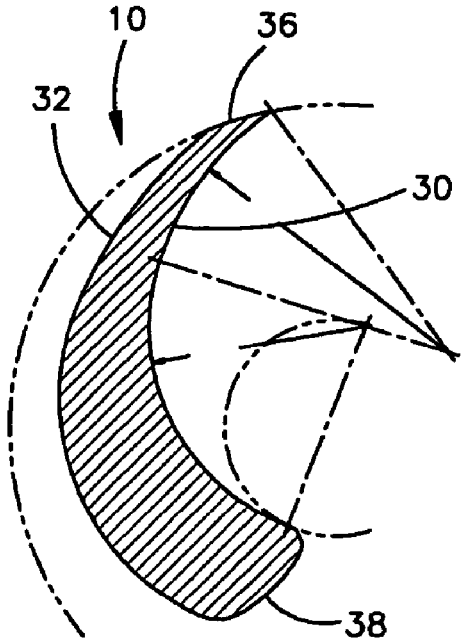
FIG. 13 is a sectional view of the vane as seen from the plane as indicated by the line 13-13 in FIG. 5.
Figure 14:
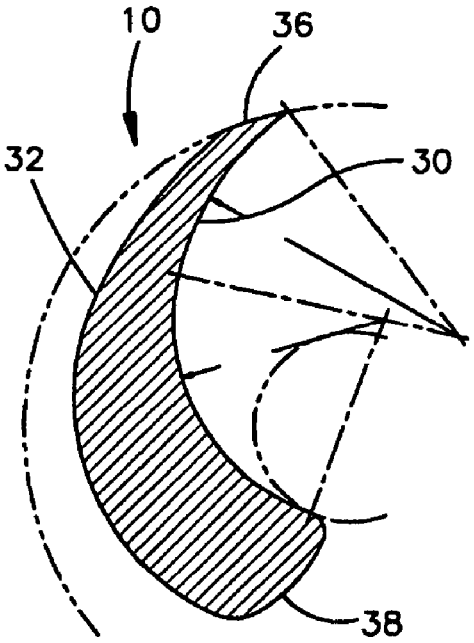
FIG. 14 is another sectional view of the vane as seen from the plane indicated by the line 14-14 in FIG. 5.
Figure 15:
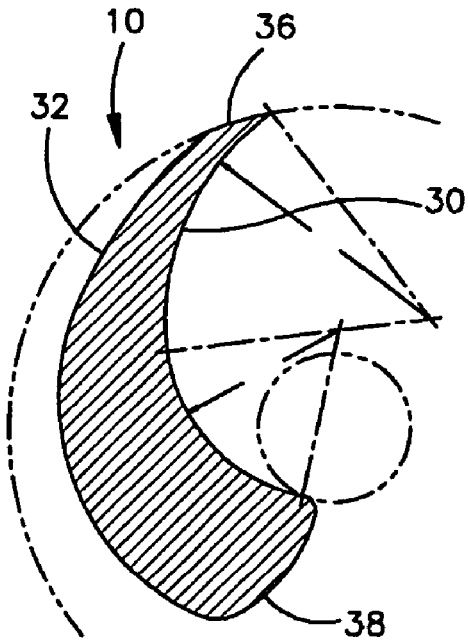
FIG. 15 is another sectional view of the vane as seen from the plane indicated from the line 15-15 in FIG. 5.

Turning now to FIG. 11, the relationship and configuration of the vanes and the associated flow channels is more clearly illustrated and exampled. The two vanes 10, 12 are designed such that a constant width not varying more than +/−10% forms a "flow channel" 40. The channel 40 is defined by the radius "R1" (2.46 R) forming a working side of the vane "Vw" and the radii "R2" (3.73 R and 4.45 R) forming the vane inside surface "Vu". (Vu and Vw correspond to the vane surfaces indicated by the reference character 30 and 38, respectively in FIG. 2.) The length of the flow channel is proportional to the distance of the working vane diameter "Dw" (6.80 dia.) minus the vane inner diameter "D1 shroud" (2.18 dia.) divided by the overall diameter of the impeller "D2" (9.75 dia.) minus the inner vane diameter "D1 shroud" (2.18 dia.). The length of the channel is also proportional to the working vane diameter "Dw" (6.80 dia.) minus the inner vane diameter "D1 top" (3.62 dia.) divided by the overall diameter of the impeller "D2" (9.75 dia.) minus the inner vane diameter "D1 top" (3.62 dia.). The inlet vane angle formed between the shroud 16 and the top 46 of the vane may vary from 0 to 20 degrees. In FIG. 11A, the angle shown is 13 degrees.

Length of Channel Formulas

Bottom of vane ratio=($Dw-D1$ shroud)/($D2-D1$ shroud)=at least 47%

Top of vane ratio=($Dw-D1$ top)/($D2-D1$ top)=at least 47%

Note: In the above example the "length of channel bottom of vane ratio"=(6.8 dia.−2.18 dia.)/(9.75 dia.−2.18 dia.)=0.61 or 61%; "length of channel top of vane ratio"=(6.8 dia.−3.62 dia.)/(9.75 dia.−3.62 dia.=0.518 or 52%)

Figure 16:
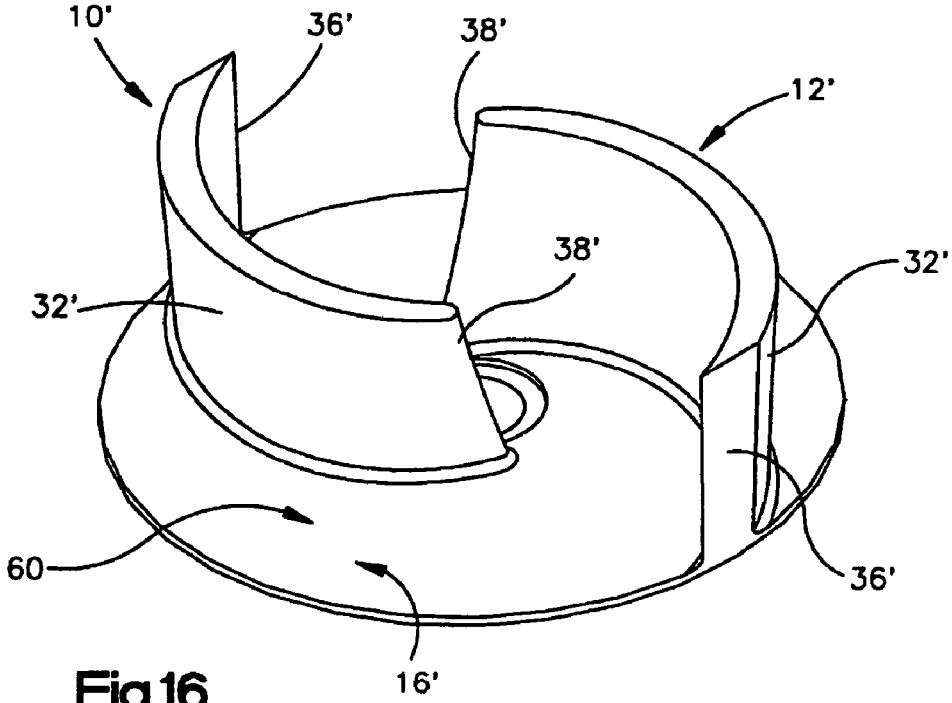
Fig.16 PRIOR ART
FIG. 16 is a perspective view of a prior art pump impeller.

FIG. 16 illustrates a prior art impeller design. The prior art impeller includes a pair of vanes 10', 12' and an integrally formed shroud 16'. As seen in FIG. 16, the vanes 10', 12' have substantially constant width. The vanes 10', 12' are relatively narrow and define relatively sharp leading edges 38' and terminate at trailing edges 36'.

Figure 17:
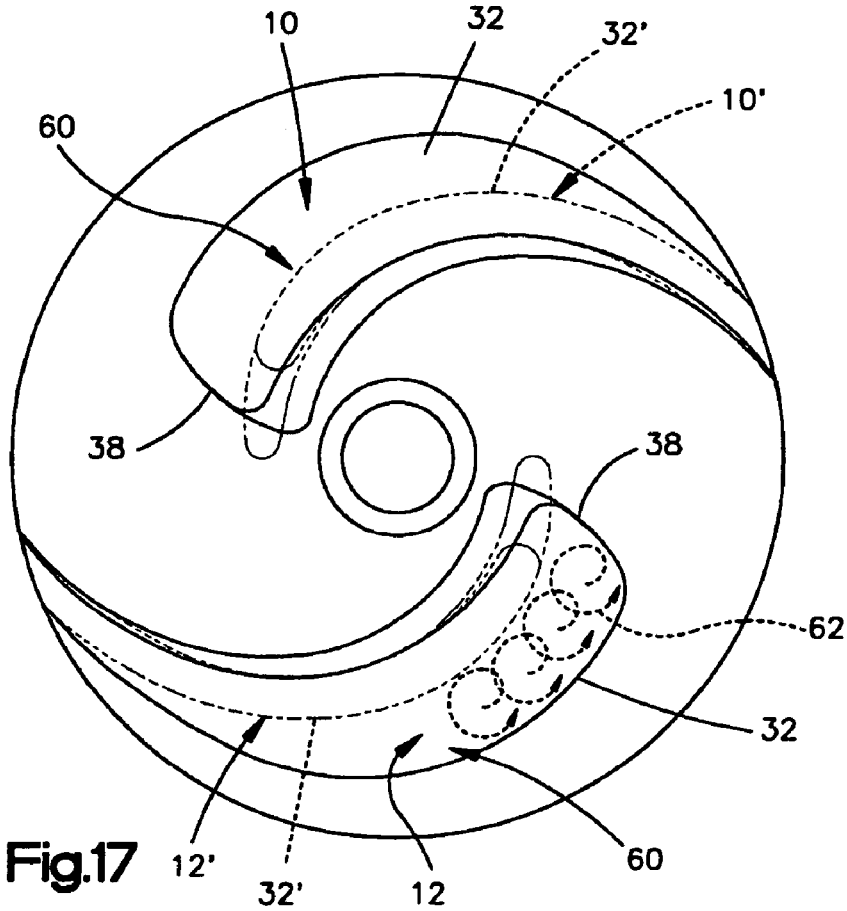
FIG. 17 is a plan view that compares the prior art impeller shown in FIG. 16 to an impeller constructed in accordance with a preferred embodiment of the invention.

FIG. 17 compares the impeller of the present invention to the prior art impeller configuration. The vanes 10, 12 of the present invention are shown in solid line whereas the prior art vanes 10', 12' are shown in dashed line. As can be seen in FIG. 17, the vanes 10, 12 of the present invention are not of constant width and are substantially wider than the prior art vanes 10', 12'. The vanes 10, 12 of the present invention extend into and overlap a "void" area indicated generally by the reference character 60 which is located to the outside of the prior art vanes 10', 12'.

It is believed that during operation of the prior art impeller, turbulence (indicated by the circular arrows 62 in FIG. 17) is generated in the fluid flowing through the void region 60 of the prior art impeller which reduces impeller efficiency and increases noise. The flow channels 40 defined by the vanes 10, 12 of the present invention or equivalent structures are absent in the prior art impeller as is apparent in FIG. 17. Each vane 10, 12 of the present invention has a working surface defined by the associated surfaces 38 and 32, which is substantially larger than a working surface 32' defined by the prior art vanes 10', 12'.

It is believed that the principles of this invention can be applied to an impeller with three vanes. Although the invention has been described with a certain degree of particularity, it should be understood that those skilled in the art, can make various changes to it without departing from the spirit or scope of the invention as hereinafter claimed.

The invention claimed is:

1. A pump impeller, comprising:

a) a shroud rotatable about an axis of rotation;

b) at least two pump vanes extending substantially axially from said shroud;

c) each vane defined by an inside wall and an outside wall, the leading edges of said walls being interconnected by a substantially blunted wall, a largest separation distance of said inside and outside walls occurring at said blunted wall;

d) said vanes arranged such that a flow channel of substantially constant width is defined at least partially between said blunted wall of one vane and at least a portion of said inside wall of said other vane.

2. The impeller of claim 1 wherein each of said vanes tapers in the axial direction beginning at an associated vane base.

3. The impeller of claim 2 wherein said tapering is achieved by inclining the inside walls of said vanes.

4. The impeller of claim 3 wherein the outside wall of each of said vanes is substantially parallel to the axis of rotation.

5. The impeller of claim 1 wherein the outside and inside walls merge with each other at a trailing end of each vane.

6. The pump impeller of claim 2 wherein a distance between the inside walls of said vanes is less at said vane base than it is at distal ends of said vanes.

7. The pump impeller of claim 1 wherein the radius of said outside wall is greater than the radius of said inside wall of a given vane.

8. A pump impeller for a centrifugal pump having a fluid inlet, comprising:

a) structure defining a shroud, said shroud being rotatable about an axis of rotation;

b) at least two spaced-apart pump vanes extending in the axial direction from said shroud, each vane having a vane base and an inlet surface spaced from said vane base and located near said pump inlet when said impeller is mounted within said pump;

c) each vane having an inside surface and an outside surface, said inside and outside surfaces defined by different radii and leading edges of said inside and outside surfaces interconnected by a blunt surface, said inside surface and outside surface having their greatest separation at said blunt surface;

d) said blunt surface of one vane and a confronting surface portion defined by the other vane that is spaced from the blunt surface of the other vane forming a flow channel through which fluid received from the pump inlet of said pump flows as said impeller is rotated.

9. The pump impeller of claim 8 wherein said flow channel has a substantially constant width.

10. The impeller of claim 8 wherein said vanes taper such that a width of said vane at said vane base is greater than a width of said vane at said inlet surface.

11. The impeller of claim 10 wherein said taper is achieved by inclining the inside surfaces of each vane outwardly such that the spacing between the vanes at said inlet surface is greater than the spacing of said vanes at said vane base.

12. The apparatus of claim 8 wherein trailing edges of the inside and outside surfaces of each vane merge together.

13. The impeller of claim 8 wherein said blunt surface and said outside surface of each vane define a working side of the vane.

14. The impeller of claim wherein the width of said flow channel does not vary by substantially more than 10%.

15. A centrifugal pump, comprising:

a) an impeller rotatable within a pump chamber for pumping fluid from a pump inlet to a pump outlet;

b) a drive member operatively connected to said pump impeller;

c) said impeller including:

i) a shroud rotatable about an axis of rotation;

ii) at least two pump vanes extending from said shroud;

iii) each of said vanes shaped as a blunted tear drop and having an inside surface and an outside surface, the leading edges of which are joined by a blunted surface, said inside and outside surfaces having their greatest separation at said blunted surface such that a flow channel is defined between the blunted surface of one vane and a confronting portion of said inside surface of the other vane.

16. The pump of claim 15 wherein said flow channels are of a substantially constant cross-section.

17. The pump of claim 15 wherein only two vanes extend from said shroud.

18. The pump of claim 16 wherein each vane is larger in width at a vane base where said vane joins said shroud as compared to a terminating surface of said vane that is located near said pump inlet.

19. The pump of claim 15 wherein each vane tapers along its axial extent with a width of said vane being larger at a vane base where said vane joins said shroud.

20. The pump of claim 18 wherein said tapering is achieved by inclining the inside surfaces of said vanes, radially outwardly.

21. The pump of claim 15 wherein said shroud includes structure for attaching said impeller to said drive member.

22. The pump of claim 15 wherein said vanes are configured such that the spacing between the vanes increases from a vane base to inlet sides of said vanes.

23. The pump of claim 15 further comprising a plurality of pump out channels on said shroud for urging fluid between an underside of said shroud and a pump housing, radially outwardly during rotation of said impeller.

* * * * *